US009598942B2

(12) United States Patent
Wells et al.

(10) Patent No.: US 9,598,942 B2
(45) Date of Patent: Mar. 21, 2017

(54) IGNITER ASSEMBLY FOR A SETTING TOOL

(71) Applicant: G&H Diversified Manufacturing LP, Houston, TX (US)

(72) Inventors: Joe Noel Wells, Lindale, TX (US); Benjamin Vascal Knight, Katy, TX (US)

(73) Assignee: G&H DIVERSIFIED MANUFACTURING LP, Houston, TX (US)

( * ) Notice: Subject to any disclaimer, the term of this patent is extended or adjusted under 35 U.S.C. 154(b) by 0 days.

(21) Appl. No.: 14/829,754

(22) Filed: Aug. 19, 2015

(65) Prior Publication Data

US 2017/0051586 A1 Feb. 23, 2017

(51) Int. Cl.
*E21B 43/1185* (2006.01)
*E21B 43/116* (2006.01)

(52) U.S. Cl.
CPC ..... *E21B 43/1185* (2013.01); *E21B 43/116* (2013.01)

(58) Field of Classification Search
CPC .... E21B 43/1185; E21B 43/24; E21B 43/119; E21B 36/04
USPC ..... 89/1.15, 1.151; 175/4.55–4.59
See application file for complete search history.

(56) References Cited

U.S. PATENT DOCUMENTS 3,032,110 A * 5/1962 Hanes ..... E21B 23/04 166/63
3,800,705 A * 4/1974 Tamplen ..... E21B 43/11855 102/204
4,561,356 A * 12/1985 Bordon ..... E21B 43/117 102/202.1
4,844,170 A * 7/1989 Gill ..... E21B 43/119 102/320
5,392,860 A * 2/1995 Ross ..... E21B 23/065 102/222
6,412,388 B1 * 7/2002 Frazier ..... E21B 43/117 102/312
7,322,416 B2 * 1/2008 Burris, II ..... E21B 23/00 166/179
7,500,528 B2 * 3/2009 McKinzie, II ..... C07C 4/02 166/302
8,079,296 B2 * 12/2011 Barton ..... E21B 43/1185 175/4.56
2006/0185898 A1 * 8/2006 Seekford ..... E21B 43/263 175/4.6
2009/0078461 A1 * 3/2009 Mansure ..... E21B 36/04 175/17
2009/0194333 A1 * 8/2009 MacDonald ..... E21B 43/24 175/45

(Continued)

*Primary Examiner* — Michael David
(74) *Attorney, Agent, or Firm* — Conley Rose, P.C.

(57) ABSTRACT

An igniter assembly is disclosed for initiating an explosive charge in a setting tool. In an embodiment, the igniter assembly includes a longitudinal axis, and a holder including a first end, a second end opposite the first end, and a through passage. In addition, the igniter assembly includes an igniter disposed within the through passage. The igniter comprises a single igniter system. Further, the igniter assembly includes a contact seal plug disposed at least partially within the through passage. The contact sealing plug is configured to sealingly engage the through passage to prevent fluid flow out of the through passage beyond the first end of the holder.

12 Claims, 5 Drawing Sheets

(56) References Cited

U.S. PATENT DOCUMENTS

| | | | | |
|---|---|---|---|---|
| 2015/0068723 | A1* | 3/2015 | Wells | E21B 43/1185 166/55.1 |
| 2016/0115753 | A1* | 4/2016 | Frazier | E21B 43/1185 166/53 |
| 2016/0333675 | A1* | 11/2016 | Wells | E21B 43/116 |

* cited by examiner

IGNITER ASSEMBLY FOR A SETTING TOOL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore and any casing pipes disposed therein with a perforating gun at each production zone to provide a path(s) for formation fluids (e.g., hydrocarbons) to flow from a production zone of a subterranean formation into the wellbore. To ensure that each production zone is isolated within the wellbore, plugs, packers, and/or other sealing devices are installed within the wellbore between each production zone prior to perforation activities. In order to save time as well as reduce the overall costs of completion activities, it is often desirable to simultaneously lower both a setting tool and at least one perforating gun along the same tool string within the wellbore in order to set the sealing device as well as perforate the wellbore in a single trip downhole. The setting tool will typically include an explosive charge to actuate and set the sealing device (e.g., plug, packer, etc.) within the wellbore. The explosive charge is initiated by an igniter disposed along the perforating gun and setting tool string.

BRIEF SUMMARY OF THE DISCLOSURE

Some embodiments disclosed herein are directed to an igniter assembly for initiating an explosive charge in a setting tool. In an embodiment, the igniter assembly includes a longitudinal axis and a holder including a first end, a second end opposite the first end, and a through passage. In addition, the igniter assembly includes an igniter disposed within the through passage. The igniter comprises a single igniter system. Further, the igniter assembly includes a contact seal plug disposed at least partially within the through passage. The contact sealing plug is configured to sealingly engage the through passage to prevent fluid flow out of the through passage beyond the first end of the holder.

Other embodiments are directed to a perforating gun assembly having a longitudinal axis. In an embodiment, the perforating gun assembly includes a perforating gun to perforate a subterranean wellbore, a setting tool to install a plug within the wellbore, and an adapter configured to connect to each of the perforating gun and the setting tool, wherein the adapter includes an internal passage. In addition, the perforating gun assembly includes an igniter assembly at least partially within the internal passage of the adapter. The igniter assembly includes a holder including a through passage, and an igniter disposed within the through passage, wherein the igniter comprises a single igniter system. In addition, the igniter assembly includes a contact seal plug disposed at least partially within the through passage. The contact sealing plug is configured to prevent fluid flow from the through passage of the holder to the internal passage of the adapter.

Still other embodiments are directed to a perforating gun assembly having a longitudinal axis. In an embodiment, the perforating gun assembly includes a perforating gun to perforate a subterranean wellbore, a setting tool to install a plug within the wellbore, and an adapter configured to connect to each of the perforating gun and the setting tool, wherein the adapter includes an internal passage. In addition, the perforating gun assembly includes an igniter assembly at least partially within the internal passage of the adapter. The igniter assembly includes a holder including a first end, a second end opposite the first end, and a through passage. In addition, the igniter assembly includes an igniter disposed within the through passage. The igniter comprises a single igniter system. Further, the igniter assembly includes a contact seal plug disposed at least partially within the through passage. The contact sealing plug is configured to sealingly engage the through passage to prevent fluid flow out of the through passage beyond the first end of the holder into the internal passage of the adapter.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION OF EXEMPLARY EMBODIMENTS

Figure 1:
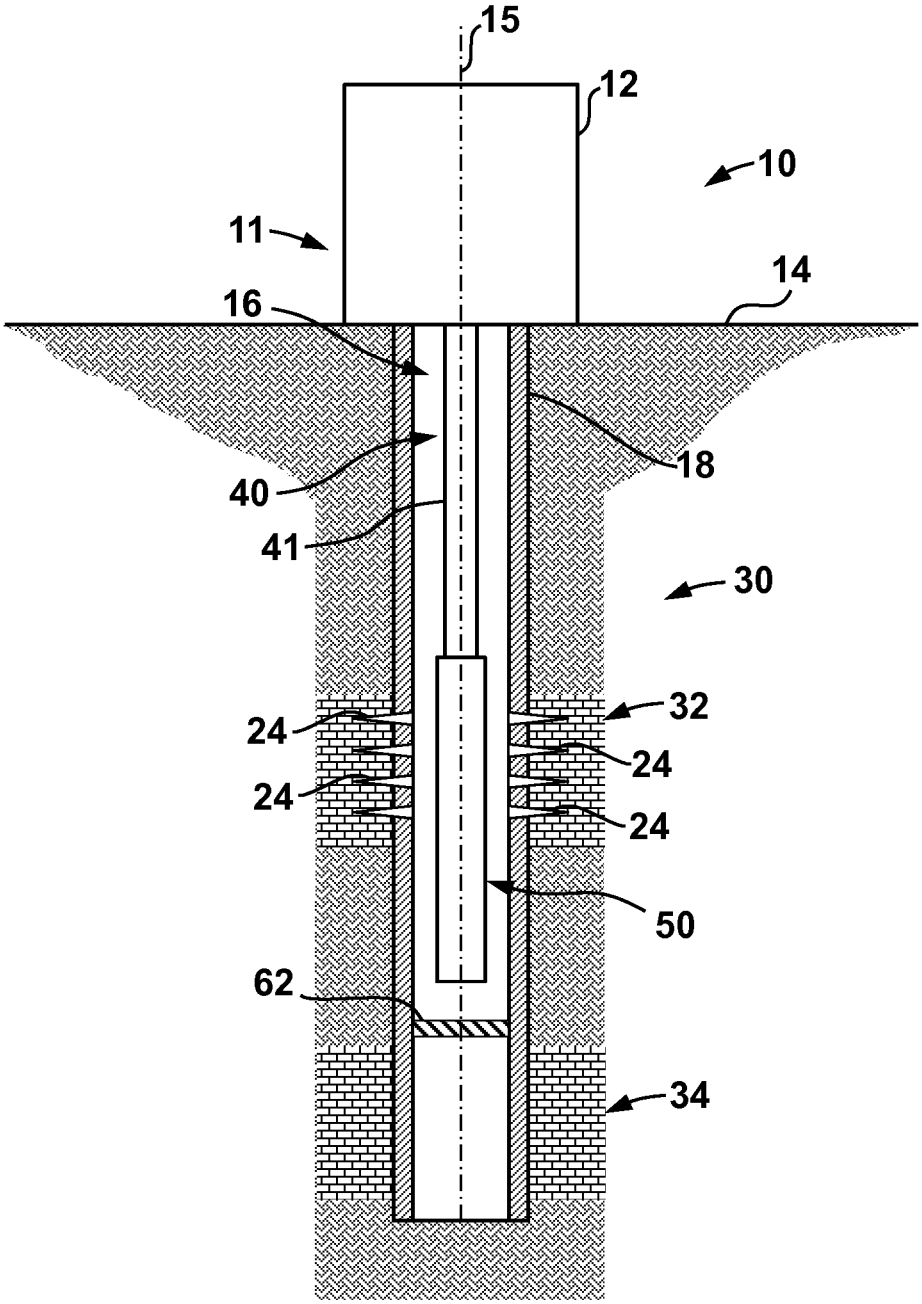
FIG. 1 is a schematic, partial cross-sectional view of a system for completing a subterranean well in accordance with at least some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

As used herein, the phrases "single igniter system" or "single igniter assembly" refers to systems that are configured to initiate an explosive charge in another component (e.g., a setting tool) with the use of only a single igniter. These systems are in contrast to dual igniter systems where a plurality of igniters (e.g., a pair—with a primary igniter and a secondary igniter) are utilized to initiate the explosive charge within the other component.

As previously described, during completion activities, a setting tool is actuated with an explosive charge that is initiated by an igniter. Conventional igniters are housed within a holder or housing that is incorporated along the tool string. Igniter holders are typically designed to house a particular type (or class) of igniter. However, igniter holders that are designed to house more economical igniters (e.g., single igniter systems such as a 074 Igniter or the like) typically have insufficient pressure containment such that during firing of the igniter and setting tool, internal pressure (and fluids) emitted from the explosive charge and igniter migrate upward past the holder into neighboring components along the tool string which may therefore result in damage to such components. Therefore, embodiments disclosed herein include igniter assemblies that have an igniter holder for housing a single igniter system and a contact seal plug installed within the igniter holder to provide additional pressure containment to protect other components disposed within the tool string during ignition of the igniter and the larger explosive charge of the setting tool.

Referring now to FIG. 1, a system 10 for completing a well 11 having a wellbore 16 extending into a subterranean formation 30 along a longitudinal axis 15 is shown. In this embodiment, formation 30 includes a first or upper production zone 32 and a second or lower production zone 34. System 10 generally comprises a surface assembly 12, wellbore 16, a casing pipe ("casing") 18 extending within and lining the inner surface of wellbore 16, and a tool string 40 extending within casing 18. Surface assembly 12 may comprise any suitable surface equipment for drilling, completing, and/or operating a subterranean well (e.g., well 11) and may include, in some embodiments, derricks, structures, pumps, electrical/mechanical well control components, etc.

Tool string 40 extends within wellbore 16 and includes an electric wireline 41 cable including at least one electrical conductor for the operation of system 10. In addition, tool string 40 includes a perforating gun assembly 50 having at least one perforating gun that is configured to emit projectiles or shaped charges (not shown) through the casing 18 and into one of the production zones 32, 34 of formation 30 thereby forming a plurality of perforations 24 that define paths for fluids contained within the production zones 32, 34 to flow into the wellbore 16 during production operations. In addition, perforating gun assembly 50 also includes at setting tool that is configured to set or install a plug or packer 62 within casing 18 during operations to isolate the production zones 32, 34 from one another. Because assembly 50 includes at least one perforating gun and a setting tool, it may be referred to herein as a "plug and shoot perforating gun assembly" 50.

Figure 2:
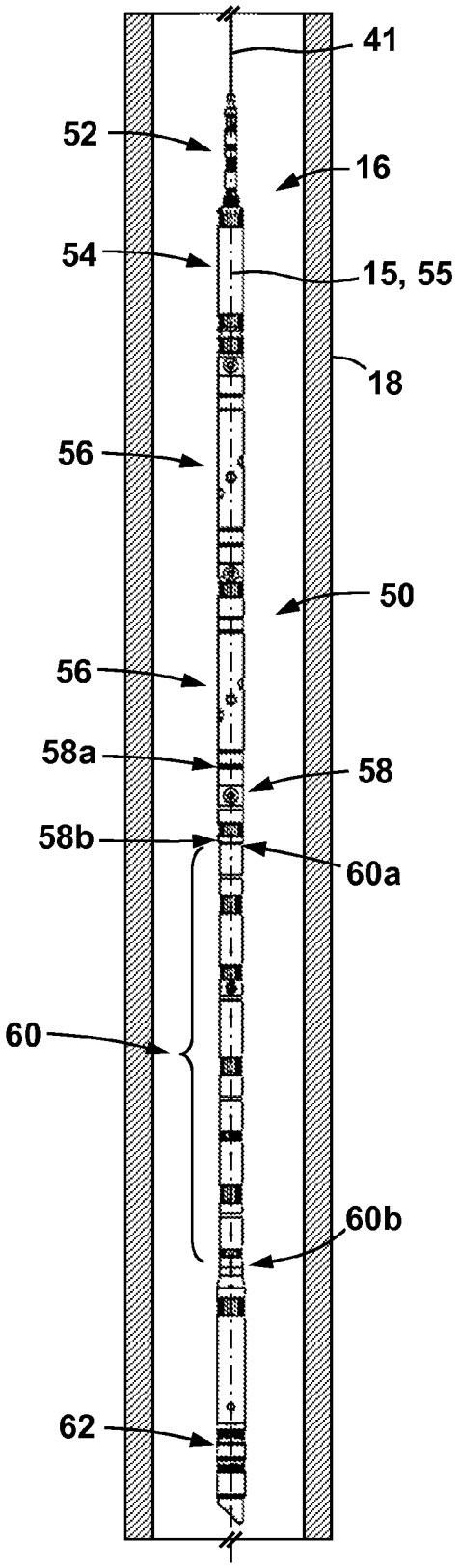
FIG. 2 is an enlarged, partial cross-sectional view of a perforating gun assembly of the system of FIG. 1 in accordance with at least some embodiments.

Referring now to FIG. 2, an embodiment of perforating gun assembly 50 is shown disposed within wellbore 16. Perforating gun assembly 50 generally includes a central or longitudinal axis 55 that is typically aligned with axis 15 of system 10, although such alignment is not required. In addition, moving axially downward from cable 41, perforating gun assembly 50 includes a cablehead 52 for coupling the other components of assembly 50 cable 41, a casing collar locator (CCL) 54, one or more (in this case two) perforating guns 56, a setting tool 60, and a packer or plug 62.

CCL 54 is utilized to measure or detect the depth of perforating gun assembly 50 within wellbore 16. For example, in some embodiments, CCL 54 includes one or more magnets that create a magnetic field surrounding CCL 54. During insertion of perforating gun assembly 50 into wellbore 16, the magnetic field is altered as it passes by the threaded connections of the tubular members making up casing 18 (because these threaded connections typically represent locations of relatively thicker sections of casing 18). The cyclical alteration or the magnetic field can be measured (through a coiled electrical conductor disposed axially between the magnets) such that operators (who may be disposed at the surface 14) may track the progress of perforating gun assembly 50 through wellbore 16 and thereby determine when assembly 50 is positioned at the desired perforating depth (e.g., at one of the zones 32, 34, in FIG. 1).

Perforating guns 56 are axially disposed below CCL 54 and may be any suitable perforation gun for perforating a wellbore (e.g., wellbore 16). For example, in some embodiments, guns 56 may each comprise a hollow steel carrier (HSC) type perforating gun, a scalloped perforating gun, or a retrievable tubing gun (RTG) type perforating gun. In addition, guns 56 may each comprise a wide variety of sizes such as, for example, 2¾", 3⅛", or 3⅜", wherein the above listed size designations correspond to an outer diameter of the perforating guns 56. Further, it should be appreciated that guns 56 may be the same type and/or size or alternatively may be different types and/or sizes.

Referring still to FIG. 2, in this embodiment setting tool 60 is axially disposed below guns 56 and is configured to set or install plug or packer 62 within casing 18 during operations as generally described above. Setting tool 60 may be any suitable setting tool for installing a packer, plug or other sealing tool(s) (e.g., packer 62) within a wellbore (e.g., wellbore 16). For example, in some embodiments, setting tool 60 may comprise a #10 or #20 Baker style setting tool. However, setting tool 60 may comprise a wide variety of sizes such as, for example, 1.68 in., 2.125 in., 2.75 in., 3.5 in., 3.625 in., or 4 in., wherein the above listed sizes correspond to the overall outer diameter of the setting tool 60. In this embodiment, setting tool 60 generally includes a first or upper end 60*a*, and a second or lower end 60*b* axially opposite upper end 60*a*.

As shown in FIG. 2, in this embodiment perforating gun assembly 50 further comprises a plug and shoot firing head adapter 58 axially disposed between the axially lowermost gun 56 and setting tool 60 and coupling each of the axially lowermost gun 56 and setting tool 60 to one another during operations. Adapter 58 may be the same as those described in U.S. patent application Ser. No. 14/025,387, the contents of which being incorporated herein by reference in their entirety for all purposes. In addition, it should be appreciated that guns 56 and setting tool 60 may be coupled to one another through any suitable device(s) or member(s) in other embodiments. For example, in other embodiments, adapter 58 comprises a plurality of components coupled to one another in an end-to-end relationship (e.g., threaded) and extending between guns 56 and setting tool 60. As shown, adapter 58 includes a first or upper end 58*a* and second or lower end 58*b* axially opposite upper end 58*a*. Upper end 58*a* is coupled to the lowermost perforating gun 56 and lower end 58*b* is coupled to setting tool 60.

Figure 3:
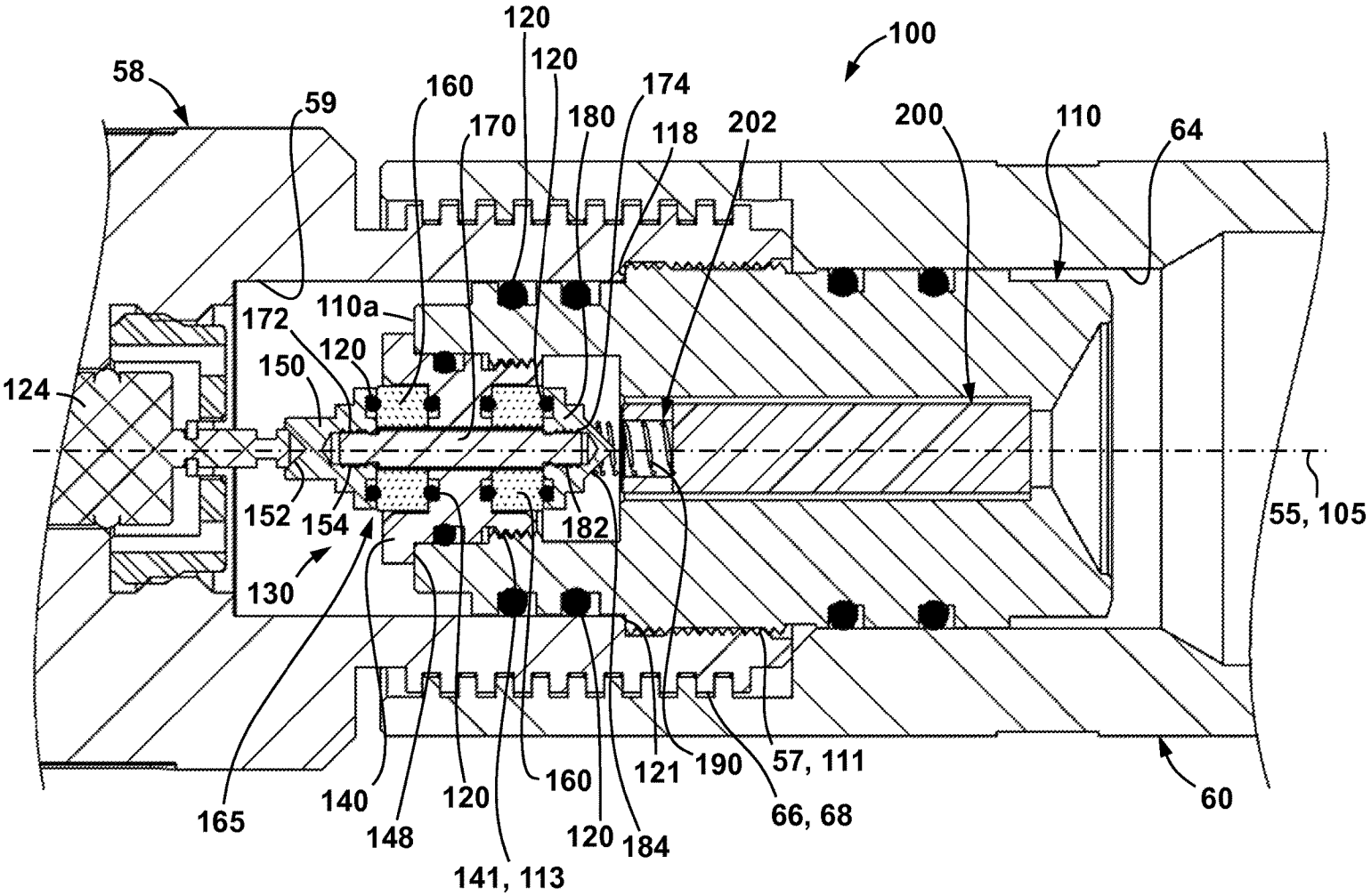
FIG. 3 is a cross-sectional view of an igniter assembly installed within the perforating gun assembly of FIG. 2 in accordance with at least some embodiments.

Referring now to FIG. 3, perforating gun assembly 50 includes an igniter assembly 100 disposed within an internal passage 64 of setting tool 60 and an internal passage 59 of adapter 58 proximate to the connection between upper end 60*a* of setting tool 60 and lower end 58*b* of adapter 58. Igniter assembly 100 is used to ignite or initiate an explosive charge within setting tool 60 to set or install packer 62 within wellbore 16 during operations (e.g., such as generally shown in FIG. 1). In this embodiment, igniter assembly 100 generally includes a central or longitudinal axis 105 that is aligned with axis 55 of perforating gun assembly 50 during operations. In addition, igniter assembly 100 includes an igniter holder 110 that further houses an igniter 200 and a contact seal plug 130.

Figure 4:
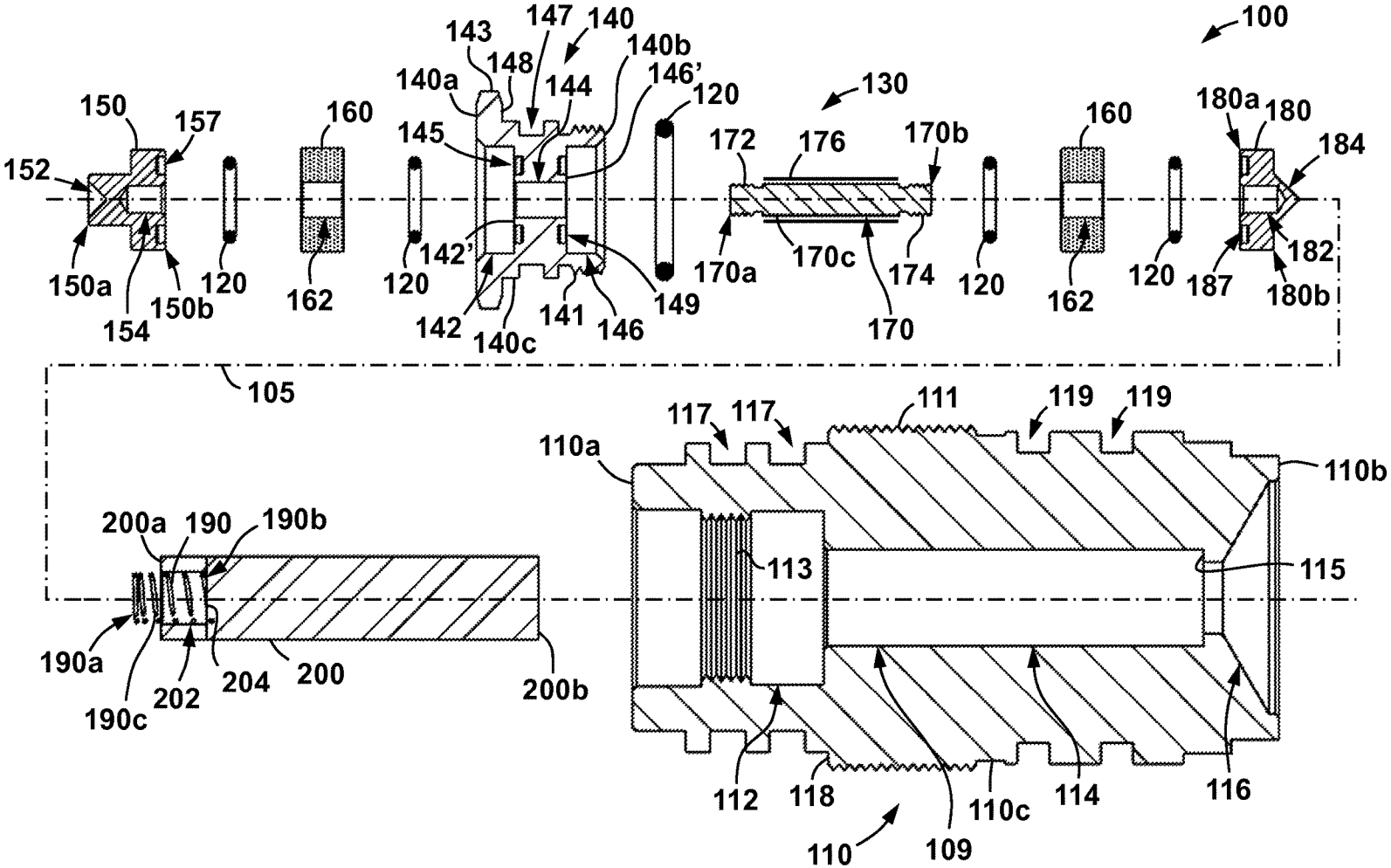
FIG. 4 is an exploded view of the igniter assembly of FIG. 3 in accordance with at least some embodiments.

Referring now to FIGS. 3 and 4, igniter holder 110 includes a first or upper end 110*a*, a second or lower end 110*b* axially opposite upper end 110*a*, and a radially outer surface 110*c* extending between ends 110*a*, 110*b*. Radially outer surface 110*c* includes a set of external threads 111 axially between ends 110*a*, 110*b*, a first pair of annular recesses 117 axially between threads 111 and upper end 110*a*, a second pair of annular recesses 119 axially between threads 111 and lower end 110*b*, and an annular shoulder 118 axially between threads 111 and recesses 117. As best shown in FIG. 3, threads 111 mate and engage with internal threads 57 on adapter 58 to secure igniter assembly 100 within passages 59, 64. In addition, recesses 117 receive sealing members 120 (e.g., O-rings) that sealingly engage recesses 117 and internal passage 59 of adapter 58, and recesses 119 receive sealing members 120 that sealingly engage recesses 119 and passage 64 of setting tool 60. Thus, fluid flow (e.g., liquid and/or gas flow) between radially outer surface 110*c* of holder 110 and passages 59, 64 is restricted and/or prevented by sealing members 120 disposed within recesses 117, 119. Sealing members 120 may comprise any suitable compliant material that facilitates a seal when compressed between two opposing surfaces. For example, members 120 may comprise nitrile, synthetic or natural rubber, etc.

Referring still to FIGS. 3 and 4, a first internal chamber 112 extends axially into holder 110 from upper end 110*a*, a second internal chamber 114 extends axially within holder 110 from first chamber 112, and a third internal chamber 116 extends axially within holder 110 from second chamber 114 to lower end 110*b*. First chamber 112 is cylindrical in shape and includes a set of internal threads 113. Second chamber 114 is also cylindrical in shape and includes an internal shoulder 115 at a position within chamber 114 that is more proximate third chamber 116 than first chamber 112. Further, third chamber 116 includes a frustoconical surface 116' that includes an inner diameter that increases when moving axially toward lower end 110*b*. Together, chambers 112, 114, 116 form a through passage 109 that extends axially through holder 110 between ends 110*a*, 110*b*.

Holder 110 may be constructed out of any suitable material that may withstand the internal pressures created when igniter 200 and the explosive charge within setting tool 60 are initiated. For example, holder 110 may comprise a high strength metal material such as, for example, 4340 alloy steel. In addition, the surfaces of holder (e.g., outer surface 110*c*, surfaces of chambers 112, 114, 116, etc.) may include one or more surface treatments or finishes to impart corrosion resistance qualities for such surfaces during operations.

Igniter 200 is disposed within second chamber 114 of holder 110 during operations (see FIG. 3) and includes a first or upper end 200*a*, a second or lower end 200*b* opposite upper end 200*a*, an axially extending recess 202 extending into igniter 200 from upper end 200*a*, and a contact surface 204 disposed within recess 202. Igniter 200 may comprise any suitable commercially available igniter which is configured to operate as a signal igniter system to initiate the explosive charge within a setting tool (e.g., setting tool 60)—i.e., igniter 200 is configured to initiate the explosives within setting tool 60 without the operation of any additional igniters. The use of such a single igniter system (e.g., igniter 200) is preferable since such igniters are less costly than other multi-igniter systems (e.g., such as dual igniter systems that include a primary igniter and secondary igniter). In some embodiments, igniter 200 may comprise a type 074 igniter.

Referring still to FIGS. 3 and 4, contact seal plug 130 is secured at least partially within first chamber 112 of holder 110, and is configured to provide electrical contact between igniter 200 and other electrical contacts uphole of igniter assembly 100 (e.g., contact 124 disposed within adapter 58 shown in FIG. 3). In addition, contact seal plug 130 provides a bulkhead seal to withstand the pressures created within setting tool 60 after initiation of the igniter 200 itself and the explosive charge in setting tool 60, to prevent damage to equipment disposed uphole of setting tool 60. In this embodiment, contact seal plug 130 includes a plug housing 140, a first or upper contact member 150, a second or lower contact member 180, and a contact rod 170.

As best shown in FIG. 4, plug housing 140 includes a first or upper end 140*a*, a second or lower end 140*b* opposite upper end 140*a*, and a radially outer surface 140*c* extending between ends 140*a*, 140*b*. Radially outer surface 140*c* includes a flange 143 at upper end 140*a* that defines a shoulder 148, a set of external threads 141 at lower end 140*b*, and a recess 147 disposed axially between shoulder 148 and threads 141. As best shown in FIG. 3, threads 141 mate and engage with internal threads 113 in first chamber 112 of holder 110 to secure plug housing 140 (and thus contact seal plug 130) at least partially within holder 110 during assembly operations. In addition, recess 147 receives a sealing member 120 that sealingly engages with recess 147 and first chamber 112 when plug housing 140 is installed therein such that fluid flow (e.g., liquid and/or gas flow)

between radially outer surface 140*c* and first chamber 112 is restricted and/or prevented. Further, flange 143 may include flats or other surface features that facilitate engagement with a tool during installation and/or makeup of igniter assembly 100. For example, in some embodiments, flange 143 may be hexagonal in shape such that a socket wrench or similar tool may be used to threadably install plug housing 140 within first chamber 112 of holder 110 as described above.

Plug housing 140 also includes a first internal chamber 142 extending axially into plug housing 140 from upper end 140*a*, a second internal chamber 144 extending axially within plug housing 140 from first chamber 142, and a third chamber 146 extending axially from second chamber 144 to second end 140*b*. Second internal chamber 144 includes an inner diameter that is smaller than each of the chambers 142, 146, and thus, first chamber 142 includes a radially extending partition wall 142' at the intersection of first chamber 142 and second chamber 144 and third chamber 146 includes a radially extending partition wall 146' at the intersection of second chamber 144 and third chamber 146. A first annular recess 145 extends axially into the partition wall 142' in first chamber 142, and a second annual recess 149 extends axially into the partition wall 146' in third chamber 149.

A pair of insulators 160 are disposed within chambers 142, 146 of plug housing 140—with one insulator 160 being disposed within first chamber 142 and another insulator 160 being disposed within third chamber 146. Each insulator 160 is cylindrical in shape and includes a throughbore 162 extending axially therethrough. Insulators 160 may be made from any suitable electrically insulating material, and in some embodiments, may comprise, for example, polytetrafluoroethylene (PTFE), polyether ether ketone (PEEK), rubber, etc.

Prior to the installation of insulators 160 within chambers 142, 146, a pair of sealing members 120 are disposed within recesses 145, 149 in chambers 142, 146, respectively. Thereafter, insulators 160 are inserted axially into chambers 142, 146 such that each engages with a corresponding one of the sealing members 120. Insulators 160 are then axially compressed within chambers 142, 146 toward second chamber 144 (e.g., by threaded engagements between contacts 150, 180 and contact rod 170 as described below), such that sealing members 120 within chambers 142, 146 are also axially compressed and therefore sealingly engage the corresponding insulator 160 and recess 145, 149, respectively, to restrict fluid flow (e.g., liquid and/or gas flow) between insulators 160 and partition walls 142', 146' of chambers 142, 146, respectively, during operations.

Contact rod 170 extends through chambers 142, 144, 146 and throughbores 162 of insulators 160 to conduct electricity between upper contact 150 and lower contact 180 (each being described in more detail below) during operations. Rod 170 is generally cylindrically shaped and includes a first or upper end 170*a*, a second or lower end 170*b* axially opposite upper end 170*a*, and a radially outer surface 170*c* extending between ends 170*a*, 170*b*. Radially outer surface 170*c* includes a first or upper set of threads 172 (or more simply "upper threads 172") extending from upper end 170*a*, and a second or lower set of threads 174 (or more simply "lower threads 174") extending from lower end 170*b*. As will be described in more detail below, upper set of threads 172 is threadably engaged with a mating set of threads within upper contact 150 and lower set of threads is threadably engaged with a mating set of threads within lower contact 180 to axially compress insulators 160 within chambers 142, 146 and secure rod 170 within plug housing 140 during assembly operations.

An insulating sleeve 176 is disposed on outer surface 170*c* axially between threads 172, 174 to insulate third chamber 144 from contact rod 170 when rod 170 extends therethrough. To that end, sleeve 176 may comprise any suitable electrically insulating material, such as, for example, any of the electrically insulating materials discussed herein for insulators 160 (e.g., PTFE, PEEK, rubber, etc.). By contrast, contact rod 170 may comprise any suitable electrically conductive material, such as, for example, stainless steel, brass, copper, mild steel, etc. Also, radially outer surface 170*c* may include one or more surface treatments or finishes to impart corrosion resistance qualities for such surfaces during operations.

Referring still to FIGS. 3 and 4, upper contact 150 includes a first or upper end 150*a*, a second or lower end 150*b* axially opposite upper end 150*a*, a first conical recess 152 extending axially into contact 150 from upper end 150*a*, and a second cylindrical recess 154 extending axially into contact 150 from lower end 150*b*. While not specifically shown in FIG. 4, cylindrical recess 154 includes internal threads extending therein that mate with the threads 172 on contact rod 170 as mentioned above. An annular recess 157 extends axially into contact 150 from lower 150*b* radially outside of cylindrical recess 154.

Lower contact 180 includes a first or upper end 180, a second or lower end 180*b* axially opposite upper end 180*a*, a cylindrical recess 182 extending axially into contact 180 from upper end 180*a*, and a conical projection extending axially from lower end 180*b*. While not specifically shown in FIG. 4, cylindrical recess 182 includes internal threads extending therein that mate with the threads 174 on contact rod 170 as mentioned above. An annular recess 187 extends axially into lower contact 180 from upper end 180*a* radially outside of cylindrical recess 187.

During assembly operations, recesses 157, 187 on contacts 150, 180, respectively, each receive a sealing member 120 therein that then engages with one of the insulators 160 when contacts 150, 180 threadably mate with threads 172, 174, respectively, on contact rod 170 as previously described above. Thus, as contacts 150, 180 threadably engage with threads 172, 174, respectively, and axially compress insulators 160 within chambers 142, 146 as previously described, sealing members 120 within recesses 157, 187 are also axially compressed such that they sealingly engage recesses 157, 187, respectively, and the corresponding insulator 160. Thus, fluid flow (e.g., liquid and/or gas flow) between ends 150*b*, 180*a* of contacts 150, 180, respectively, and the corresponding insulators 160 is restricted and/or prevented by sealing members 120 within recesses 157, 187, respectively. As a result, the sealing members 120 disposed within recesses 157, 187, 145, 149, and insulators 160, 176 form a sealing assembly 165 that prevents or at least restricts fluid flow (e.g., liquid and/or gas flow) axially through contact seal plug 130 during ignition operations. In addition, sealing assembly 165 is also configured to electrically insulate electrical contacts 150, 180, and contact rod 170 from plug housing 140.

Referring still to FIGS. 3 and 4, a biasing member 190 is disposed between lower contact 180 and igniter 200 to conduct electricity between lower contact 180 and igniter 200 during operations. Biasing member 190 may comprise any suitable member or device configured to axially bias two adjacent members apart from one another. In this embodiment, biasing member 190 comprises a coiled spring that includes a first or upper end 190*a*, a second or lower end 190*b* axially opposite upper end 190*a*, and a body 190*c* extending helically between ends 190*a*, 190*b* with respect to axis 105. While not specifically shown, upper end 190*a* may include a curved aperture (e.g., circular, oval, etc.) that is configured to receive and mate with conical projection 184 on lower contact 180 during assembly operations. Biasing member 190 may comprise any suitable electrically conductive material such as, for example, a metal (e.g., carbon steel, stainless steel, etc.).

To assemble contact seal plug 130, insulating sleeve 176 is installed on radially outer surface 170*c* of contact rod 170 and rod 170 (with sleeve 176 disposed thereon) is inserted axially within plug housing 140. Specifically, rod 170 extends through each of the chambers 142, 144, 146 such that ends 170*a*, 170*b* protrude axially beyond ends 140*a*, 140*b* of plug housing 140, respectively. Next, sealing members 120 are installed within recesses 145, 149 within chambers 142, 146, respectively, and insulators 160 are inserted axially within chambers 142, 146 until they abut with sealing members 120 in recesses 145, 149 in the manner described above. As insulators 160 are inserted within chambers 142, 146, rod 170 (and sleeve 176 disposed thereon) is received through throughbores 162 of insulators 160 such as is shown in FIG. 3. Thereafter, additional sealing members 120 are installed within recesses 157, 187 on contacts 150, 180, respectively. Next, upper threads 172 are threadably engaged with the mating threads in recess 154 in contact 150 and lower threads 174 are threadably engaged with the mating threads in recess 182 in contact 180. As contacts 150, 180 are further threadably engaged to ends 170*a*, 170*b* of rod 170, respectively, insulators 160 are axially compressed between contacts 150, 180 within chambers 142, 146 in the manner described above.

After contact seal plug 130 is assembled in the manner described above, it may then be installed within first chamber 112 of holder 110. Specifically, igniter 200 is inserted axially within second chamber 114 until lower end 200*b* axially abuts with shoulder 115. Biasing member 190 is then inserted within holder 110 such that lower end 190*b* is received within recess 202 and abuts with contact surface 204. Thereafter, contact seal plug 130 is inserted within first chamber 112 such that upper end 190*a* of biasing member 190 receives and mates with conical projection 184 on lower contact 180. To further secure contact seal plug 130 within chamber 112, external threads 141 on plug housing 140 are engaged with internal threads 113 in chamber 112 as also previously described above, until shoulder 148 on flange 143 abuts or engages with upper end 110*a* of holder 110. As contact seal plug 130 is threadably inserted within chamber 112 biasing member 190 is axially compressed between lower contact 180 and igniter 200 such that a complete electrical connection is formed between upper contact 150 and igniter 200 through contact rod 170, lower contact 180, and biasing member 190.

Referring again to FIGS. 1-3, during operations, the assembled igniter assembly 100 is installed within passage 59 of adapter 58 by threadably engaging external threads 111 on holder 110 within internal threads 57 in passage 59 until shoulder 118 on holder abuts or engages with an internal shoulder 121 in passage 59. During this process, sealing members 120 in recesses 117 are radially compressed between recesses 117 and passage 59 to provide an internal seal between radially outer surface 110*c* and passage 59 in the manner described above. In addition, as holder assembly 100 is inserted and secured within passage 59 of adapter 58, an electrical contact 124 extending within adapter 58 is received within and mates with conical recess 152 in upper contact 150. While not specifically shown, electrical contact 124 is electrically coupled to other components along tool string 40 (see FIG. 1), such as, for example, equipment disposed at the surface 14, which may generate and route a firing signal from the surface 14, through string 40 to contact 124 for initiating the explosive charge within igniter 200 (which then initiates the explosive charges within the setting tool 60). Thus, because igniter 200 is electrically coupled to upper contact 150 through contact rod 170, lower contact 180, and biasing member 190 as previously described, the engagement between contact 124 and recess 152 of upper contact 150 completes the electrical connection between other components within string 40 and igniter 200.

Thereafter, setting tool 60 is secured to adapter 58 by mating engagement between internal threads 66 extending from upper end 60*a* of setting tool 60 and external threads 68 extending from lower end 58*b* of adapter 58. As setting tool 60 and adapter 58 are secured to one another, lower end 110*b* of holder 110 is received within passage 64 of setting tool 60 such that lower end 200*b* of igniter 200 is exposed to passage 64 of setting tool 60 through third chamber 116 of holder 110.

Thereafter, when it becomes desirable to set or install the plug or packer 62 within wellbore 16, a firing signal is routed from the surface 14 through tool string 40 and eventually into contact 124 in adapter 58 (see FIG. 3). The firing signal is then electrically conducted through contact seal plug 130, and particularly from upper contact 150 to lower contact 180 through contact rod 170. The firing signal is prevented from short circuiting to plug housing 140 (and thus holder 110, adapter 58, and setting tool 60) by the insulators 160 disposed within chambers 142, 146 and insulating sleeve 176 disposed radially between radially outer surface 170*c* of rod 170 and second chamber 142 of plug housing 140. Upon reaching lower contact 180, the firing signal is then routed through biasing member 190 and into igniter 200 via contact surface 204. Once received by igniter 200, the firing signal causes igniter 200 to initiate an explosive charge that results in fluids and pressure waves that are emitted from third chamber 116 of holder 110 and directed through internal passage 64 to initiate (e.g., ignite) the relatively larger explosive charge(s) within setting tool 60 to cause installation of packer 62 within wellbore 16 as previously described.

During this ignition procedure, pressure waves and fluids emitted from both the exploding charges within igniter 200 and setting tool 60 are restricted from communicating with internal passage 59 of adapter 58 by the sealing members 120 disposed between holder 110 and passages 59, 64, and the sealing members 120 disposed within contact seal plug 130 (e.g., sealing members 120 between plug housing 140 and chamber 112, and between insulators 160, chambers 142, 146, and contacts 150, 180—all previously described). As a result, components and equipment disposed within tool string 40 uphole of setting tool 60 are protected from damage during these operations.

In addition, after the ignition operations described above, one or more of the components of igniter assembly 100, such as, for example, contact seal plug 130 and igniter holder 110, may be reused in another ignition operation (e.g., after tool string 40 is pulled to the surface 14 and a new igniter 200 is placed within chamber 114). However, it should be appreciated that in other embodiments, one or more of the components of igniter assembly 100 are designed to be used in only a single ignition operation. For example, referring now to FIGS. 5 and 6 an embodiment of igniter assembly 300 for use within perforating gun assembly 50 (see FIGS. 1 and 2) in place of igniter assembly 100, is shown. Igniter assembly 300 is generally the same as igniter assembly 100, previously described, and thus, the description below will focus on the features of igniter assembly 300 that are different from igniter assembly 100. As a result, like reference numerals will be used to refer to like components in the following description and corresponding figures (e.g., FIGS. 5 and 6).

Igniter assembly 300 generally includes igniter holder 110, igniter 200, and biasing member 190, each being the same as previously described. In addition, igniter assembly 300 includes a contact seal plug 330 that is designed to be used in only a single ignition operation and then discarded thereafter. As a result, contact seal plug 330 may be referred to herein as a "disposable" contact seal plug 330. Contact seal plug 330 includes a plug housing 340 and a contact rod 370 disposed within housing 340.

Figure 6:
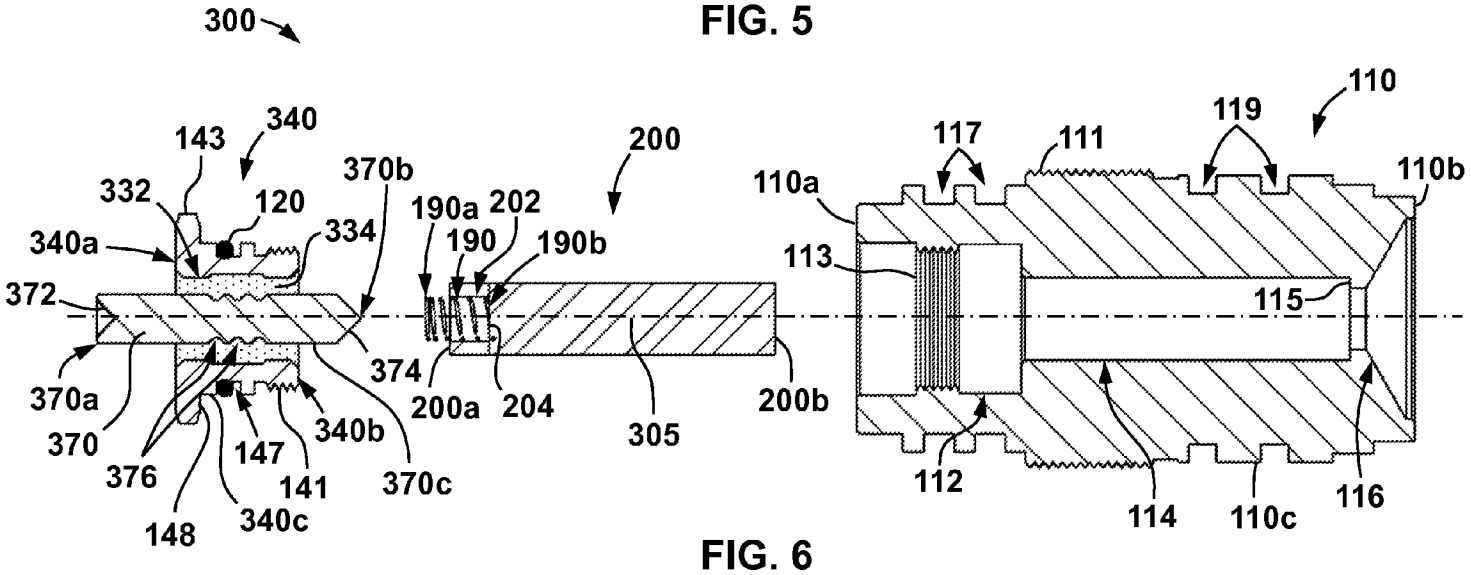
FIG. 6 is an exploded view of the igniter assembly of FIG. 5 is in accordance with at least some embodiments.

As best shown in FIG. 6, plug housing 340 includes a first or upper end 340*a*, a second or lower end 340*b* opposite upper end 340*a*, and a radially outer surface 340*c* extending between ends 340*a*, 340*b*. Radially outer surface 340*c* is generally the same as outer surface 140*c* of plug housing 140, previously described (see FIG. 4). Specifically, radially outer surface 340*c* includes flange 143 at upper end 340*a* that defines shoulder 148, external threads 141 at lower end 340*b*, and recess 147 disposed axially between shoulder 148 and threads 141 that receives sealing member 120. In addition, plug housing 340 includes a central throughbore 332 extending axially between ends 340*a*, 340*b*.

Contact rod 370 includes a first or upper end 370*a*, a second or lower end 370*b* opposite upper end 370*a*, and a radially outer surface 370*c* extending axially between ends 370*a*, 370*b*. A conical recess 372 extends axially into rod 370 from upper end 370*a*, and lower end 370*b* includes an axially extending conical projection 374. In addition, radially outer surface 370*c* includes a plurality of annular grooves 376 that extend circumferentially about axis 105. Grooves 376 are axially positioned between recess 372 and projection 374 along radially outer surface 370*c*. As with contact rod 170, previously described, contact rod 370 is configured to conduct electricity between electrical contacts disposed within tool string 40 uphole of igniter assembly 300 and igniter 200 during operations. Thus, contact rod 370 may be made from any suitable electrically conductive material, such as, for example, any of the materials mentioned above for constructing contact rod 170.

Figure 5:
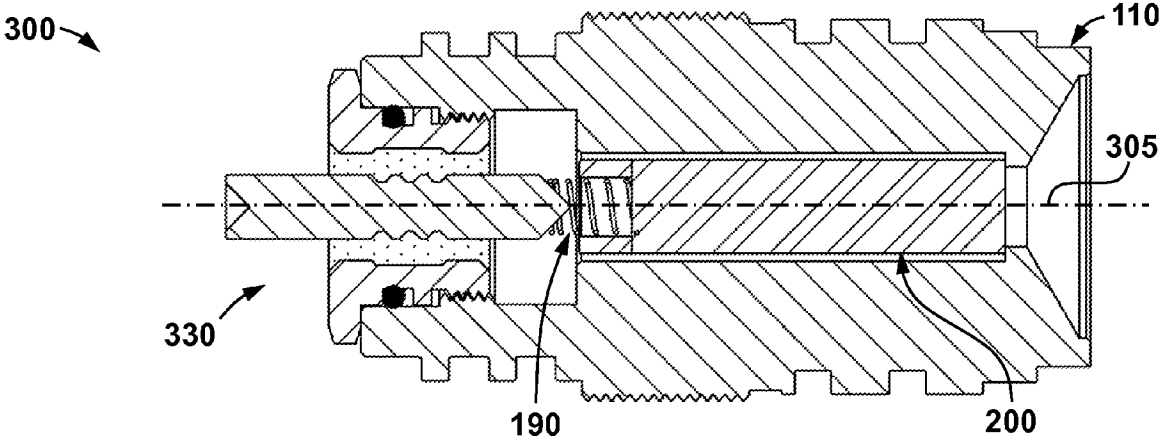
FIG. 5 is a cross-sectional view of an igniter assembly for use within the perforating gun assembly of FIG. 2 in accordance with at least some embodiments.

Referring still to FIGS. 5 and 6, to assemble contact seal plug 330, contact rod 370 is concentrically inserted within throughbore 332 of plug housing 340 such that conical projection 374 at lower end 370*b* extends axially beyond lower end 340*b* of housing 340, upper end 370*a* and recess 372 extend axially beyond upper end 340*a* of housing 340, and grooves 376 are disposed within throughbore 332. Thereafter an insulating material 334 is inserted within throughbore 332 and around radially outer surface 370*c* of contact rod 370.

Insulating material 334 may be inserted within throughbore 332 and about contact rod 370 in any suitable manner, such as, for example, by molding (e.g., injection molding, compression molding, etc.). Specifically, in some embodiments, insulating material 334 is heated to at least a semi-liquid state and then flowed or otherwise inserted into throughbore 332 thereby filling the annular gap extending radially between radially outer surface 370*c* of contact rod 370 and the inner surface of throughbore 332. During this process, the at least semi-liquid insulating material 334 flows into the plurality of grooves 376. Without being limited to this or any other theory, grooves 376 provide an increased amount of surface area contact between radially outer surface 370*c* of rod 370 and insulation material 334 which promotes better adhesion and contact between insulating material 334 and contact rod 370. As a result, contact rod 370 may remain secured within throughbore 332 via insulating material 334 during ignition operations of igniter 200 (where high pressure and fluids exert axially directed forces on contact rod 370 as well as other components). In addition, once installed within throughbore 332, insulating material 334 provides a fluid-tight barrier extending radially between rod 370 and the internal surface of throughbore 332 that restricts and/or prevents the flow of fluids (e.g., liquids and/or gases) within throughbore 332 around contact rod 370 during ignition operations. Thus, insulating material 334 forms a sealing assembly that prevents and/or restricts fluid flow (e.g., liquid and/or gas flow) between contact rod 370 and plug housing 340 during operations.

Insulating material 334 is also configured to electrically insulate contact rod 370 from plug housing 340 in a manner similar to the insulators 160 and sleeve 176 in contact seal plug 130, previously described. Therefore, like insulators 160 and sleeve 176, insulating material 334 may be made from any suitable electrically insulating material, and in some embodiments, may comprise, for example, PTFE, PEEK, rubber, etc.

Referring still to FIGS. 5 and 6, once contact rod 370 is secured within throughbore 332 via insulating material 334, igniter 200 is installed within second chamber 114 of holder 110, and biasing member 190 is inserted within recess 202 such that lower end 190*b* engages with contact surface 204 in the manner described above. In addition, a sealing member 120 is installed within recess 147 and the now assembled contact seal plug 330 is threadably secured within first chamber 112 of igniter holder 110 via engagement between threads 141, 113 until shoulder 148 of housing 340 abuts or engages with upper end 110*a* of holder 110 in the manner previously described above. Further, as contact seal plug 330 is threadably secured within first chamber 112 of holder 110, conical projection 374 on contact rod 370 is received by and mates with upper end 190*a* of biasing member 190 such that electric current passing through contact rod 370 may pass through biasing member 190 and into igniter 200 in the same manner as described above for igniter assembly 100.

Referring now to FIGS. 3, 5, and 6, upon securing contact seal plug 330 within holder 110, the now fully assembled igniter assembly 300 may then be installed within perforating gun assembly 50 in the same manner as described above for igniter assembly 100, except that lower contact 124 in adapter 58 (see FIG. 3) engages with conical recess 372 rather than recess 152 in upper contact 150 (since no upper contact 150 is included in contact seal plug 330). Thereafter, ignition operations for igniter 200 are carried out in substantially the same manner as previously described, with electric current passing from contact 124 (see FIG. 3) through contact rod 370, biasing member 190, and into igniter 200 via contact surface 204, which then initiates an explosive charge to further initiate a larger explosive charge within setting tool 60 as previously described. During these operations, pressure and fluids (e.g., liquids and/or gases) emitted resulting from the ignition of both igniter 200 and the explosive charges disposed within setting tool 60 are prevented from migrating uphole of contact seal plug 330. As a result, components and equipment disposed within tool string 40 uphole of setting tool 60 are protected from damage during these operations.

In the manner described, a contact seal plug (e.g., contact seal plugs 130, 330) is installed within an igniter holder (e.g., holder 110) to provide additional internal sealing and support for a single igniter system for initiating a charge within a setting tool. Thus, use of such a contact seal plug and holder allows the use of the more economical single igniter systems, while providing adequate pressure containment to protect other components disposed along the tool string (e.g. tool string 40).

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, while embodiments disclosed herein have included igniter assemblies (e.g., igniter assemblies 100, 300) incorporated into a tool string (e.g., tool string 40) including one or more perforating guns (e.g., perforating guns 56), it should be appreciated that other embodiments may incorporate an igniter assembly along a tool string that does not include a perforating gun. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A perforating gun assembly having a longitudinal axis, the perforating gun assembly comprising:
- a perforating gun to perforate a subterranean wellbore;
- a setting tool to install a plug within the wellbore;
- an adapter configured to connect to each of the perforating gun and the setting tool, wherein the adapter includes an internal passage; and
- an igniter assembly at least partially within the internal passage of the adapter, wherein the igniter assembly includes:
  - a holder including a through passage;
  - an igniter disposed within the through passage, wherein the igniter comprises a single igniter system; and
  - a contact seal plug disposed at least partially within the through passage, wherein the contact sealing plug is configured to prevent fluid flow from the through passage of the holder to the internal passage of the adapter.

2. The perforating gun assembly of claim 1, wherein the contact seal plug comprises:
- a plug housing;
- a contact rod extending through the plug housing, wherein the contact rod is electrically coupled to an electrical contact disposed within the internal passage of the adapter; and
- a sealing assembly configured to restrict fluid flow between the contact rod and the plug housing.

3. The perforating gun assembly of claim 1, wherein the contact rod is electrically insulated from the plug housing.

4. The perforating gun assembly of claim 3, wherein the contact seal plug further comprises:
- a first contact threadably engaged with a first end of the contact rod;
- a second contact threadably engaged with a second end of the contact rod; and
- wherein the first end of the contact rod is opposite the second end of the contact rod.

5. The perforating gun assembly of claim 4, wherein the plug housing comprises:
- a first end;
- a second end opposite the first end of the plug housing;
- a first chamber extending axially into the plug housing from the first end of the plug housing;
- a second chamber extending axially into the plug housing from the second end of the plug housing; and
- a third chamber extending axially between the first chamber and the second chamber;
- wherein the contact rod extends through each of the first chamber, the second chamber, and the third chamber;
- wherein the first contact is electrically insulated from the plug housing with a first insulator disposed about the contact rod and inserted within the first chamber; and
- wherein the second contact is electrically insulated from the plug housing with a second insulator disposed about the contact rod and inserted within the second chamber.

6. The perforating gun assembly of claim 5, wherein the first chamber includes a first radially extending partition wall;
- wherein the second chamber includes a second radially extending partition wall; and
- wherein the sealing assembly comprises:
  - a first sealing member disposed axially between the first contact and the first insulator;
  - a second sealing member disposed axially between the first insulator and the first partition wall;
  - a third sealing member disposed axially between the second partition wall and the second insulator; and
  - a fourth sealing member disposed axially between the second insulator and the second contact.

7. The perforating gun assembly of claim 6, wherein at least one of the first sealing member, the second sealing member, the third sealing member, and the fourth sealing member comprises an O-ring.

8. The perforating gun assembly of claim 3,
- wherein the plug housing comprises:
  - a first end;
  - a second end opposite the first end of the plug housing; and
  - a throughbore extending axially between the first end and the second end of the plug housing;
- wherein the contact rod extends through the throughbore;
- wherein the sealing assembly includes an electrically insulating material disposed within the throughbore and about the contact rod.

9. A perforating gun assembly having a longitudinal axis, the perforating gun assembly comprising:
- a perforating gun to perforate a subterranean wellbore;
- a setting tool to install a plug within the wellbore;
- an adapter configured to connect to each of the perforating gun and the setting tool, wherein the adapter includes an internal passage; and
- an igniter assembly at least partially within the internal passage of the adapter, wherein the igniter assembly includes:
  - a holder including a first end, a second end opposite the first end, and a through passage;
  - an igniter disposed within the through passage, wherein the igniter comprises a single igniter system; and
  - a contact seal plug disposed at least partially within the through passage, wherein the contact sealing plug is configured to sealingly engage the through passage to prevent fluid flow out of the through passage beyond the first end of the holder into the internal passage of the adapter.

10. The perforating gun assembly of claim 9, wherein the contact seal plug comprises:

a plug housing comprising:

a first end;

a second end opposite the first end of the plug housing;

a first chamber extending axially into the plug housing from the first end of the plug housing, the first chamber including a first radially extending partition wall;

a second chamber extending axially into the plug housing from the second end of the plug housing; and a third chamber extending axially between the first chamber and the second chamber, the third chamber including a second radially extending partition wall;

a contact rod extending through the first chamber, the second chamber, and the third chamber of the plug housing, wherein the contact rod includes a first end and a second end; and a first contact threadably engaged with the first end of the contact rod;

a second contact threadably engaged with the second end of the contact rod; and a first insulator disposed about the contact rod and axially between the first contact and the first partition wall in the first chamber;

a second insulator disposed about the contact rod and axially between the second contact and the second partition wall in the third chamber.

11. The perforating gun assembly of claim 10, wherein the contact seal plug further comprises a sealing assembly configured to restrict fluid flow between the contact rod and the plug housing, the sealing assembly comprising:

a first sealing member disposed axially between the first contact and the first insulator;

a second sealing member disposed axially between the first insulator and the first partition wall;

a third sealing member disposed axially between the second partition wall and the second insulator; and a fourth sealing member disposed axially between the second insulator and the second contact.

12. The perforating gun assembly of claim 9, a plug housing including a first end, a second end opposite the first end of the plug housing and a throughbore extending axially between the first end and the second end of the plug housing;

a contact rod extending through throughbore of the plug housing; and an electrically insulating material disposed within the throughbore and about the contact rod, wherein the electrically insulating material is configured to restrict fluid flow between the throughbore of the plug housing and the contact rod.

* * * * *